US006073345A

United States Patent [19]

Mori et al.

[11] Patent Number: 6,073,345

[45] Date of Patent: Jun. 13, 2000

[54] METHOD OF MANUFACTURING A TAPPET

[75] Inventors: Akiyoshi Mori, Yokohama; Tatsuo Kanzaki, Yamato, both of Japan

[73] Assignee: Fuji Oozx, Inc.

[21] Appl. No.: 09/089,912

[22] Filed: Jun. 3, 1998

Related U.S. Application Data

[62] Division of application No. 08/965,725, Nov. 7, 1997, Pat. No. 5,943,990.

[30] Foreign Application Priority Data

Nov. 19, 1996 [JP] Japan ..... 8-307977

[51] Int. Cl.[7] ..... B23P 15/00

[52] U.S. Cl. ..... 29/888.43; 123/90.51

[58] Field of Search ..... 29/888.43; 123/90.51, 123/90.48; 74/569; 228/193, 194

[56] References Cited

U.S. PATENT DOCUMENTS

| | | | |
|---|---|---|---|
| 3,180,022 | 4/1965 | Briggs et al. . | |
| 3,649,380 | 3/1972 | Tauschek . | |
| 3,683,876 | 8/1972 | Lesher . | |
| 3,993,238 | 11/1976 | Brook et al. . | |
| 4,046,305 | 9/1977 | Brown et al. . | |
| 4,122,817 | 10/1978 | Matlock . | |
| 4,230,491 | 10/1980 | Behnke . | |
| 4,317,433 | 3/1982 | Fuhrmann . | |
| 4,695,699 | 9/1987 | Yagii et al. . | |
| 4,768,476 | 9/1988 | Behnke et al. . | |
| 4,829,950 | 5/1989 | Kanamaru et al. . | |
| 4,838,474 | 6/1989 | Ohashi et al. | 228/194 |
| 4,852,531 | 8/1989 | Abkowitz et al. . | |
| 4,873,150 | 10/1989 | Doi et al. . | |
| 4,890,784 | 1/1990 | Bampton | 228/194 |
| 4,909,198 | 3/1990 | Shiraya et al. . | |
| 4,948,031 | 8/1990 | De Clerck . | |
| 5,001,019 | 3/1991 | Ito et al. . | |
| 5,044,546 | 9/1991 | DeClerck | 228/194 |
| 5,060,607 | 10/1991 | Taniguchi . | |
| 5,168,841 | 12/1992 | Suzuki et al. . | |
| 5,226,977 | 7/1993 | Kitaguchi et al. . | |
| 5,251,587 | 10/1993 | Mori . | |

(List continued on next page.)

FOREIGN PATENT DOCUMENTS

| | | |
|---|---|---|
| 03036231 | 2/1991 | European Pat. Off. . |
| 0592908 | 4/1994 | European Pat. Off. . |
| 06212915 | 8/1994 | European Pat. Off. . |
| 0 701 003 | 3/1996 | European Pat. Off. . |
| 0701003 | 3/1996 | European Pat. Off. . |
| 56-13164 | 3/1981 | Japan . |
| 62-197609 | 9/1987 | Japan . |
| 64-22497 | 1/1989 | Japan . |
| 2-92494 | 4/1990 | Japan . |
| 5-171908 | 7/1993 | Japan . |

OTHER PUBLICATIONS

Database WPI, Section CH, Week 9213, Derwent Publications Ltd., Class L02, JP 04046069A (Toyo Kogyo Co), Feb. 17, 1992, abstract.

Database WPI, Section Ch, Week 9434, Derwent Publications Ltd., Class M13, AN 94–276189 JP 06207555 A (Nissan Motor Co Ltd), Jul. 26, 1994, abstract.

Patent Abstracts of Japan, vol. 018, No. 579 (M–1698), Nov. 7, 1994, JP 06212915 A, Aug. 4, 1994.

Patent Abstracts of Japan, vol. 015, 167 (C–0827), Apr. 26, 1991, JP 03036231 A, Feb. 15, 1991.

*Primary Examiner*—Irene Cuda

*Attorney, Agent, or Firm*—Graham & James LLP

[57] ABSTRACT

A tappet is used in an internal combustion engine. A cam-slidably-contacting member is placed on a top wall of a tappet body via diffusing material that includes a mixture of one or more elements of Zn, Mg, Sn, Cu and Pb. The cam-slidably-contacting member and the tappet body are pressed with the diffusing material held therebetween, so that the diffusing material is diffused into the tappet body and the cam-slidably-contacting member until the layer of the diffusing material does not substantially remain, and a tappet of high strength is formed.

6 Claims, 2 Drawing Sheets

U.S. PATENT DOCUMENTS 5,284,112 2/1994 Takehara et al. .
5,400,749 3/1995 Koizumi et al. .
5,431,136 7/1995 Kenmoku et al. .
5,517,956 5/1996 Jette et al. ..... 123/188.3
5,575,064 11/1996 Fujiwara et al. ..... 29/888.2
5,609,128 3/1997 Hirose .
5,662,076 9/1997 Ohtsubo et al. .
5,743,222 4/1998 Adachi .
5,783,314 7/1998 Yamagiwa et al. ..... 148/516
5,809,644 9/1998 Adachi ..... 29/888.43

METHOD OF MANUFACTURING A TAPPET

This is a division of application Ser. No. 08/965,725, filed Nov. 7, 1997, now U.S. Pat. No 5,943,990.

BACKGROUND OF THE INVENTION

The present invention relates to a tappet in an internal combustion engine and a method of manufacturing the same, and especially to a tappet made of an Al or Al-based alloy.

In order to increase wear resistance of the cam-slidably-contacting surface of a conventional Al tappet in an internal combustion engine, a cam-slidably-contacting member made of wear resistant material such as Fe-based alloy and ceramics is soldered on a cam-slidably-contacting portion of an Al alloy tappet. Between the tappet body and the cam-slidably-contacting member, soldering material having lower melting point than those of both is put, heated and melted.

In the conventional tappet, the tappet body and the cam-slidably-contacting member are made of different material, i.e. one is Al, while the other is Fe. The soldering material usable therefor is limited to one which can be welded to both, and range for selection is small. After soldering, an intermediate layer which consists of soldering material which remains between the tappet body and the cam-slidably-contacting member after soldering is weak in strength.

SUMMARY OF THE INVENTION

In view of the above disadvantage involved in the prior art, it is an object of the present invention to provide a method of manufacturing an Al tappet in an internal combustion engine and such that both the tappet and a cam-slidably-contacting member being made of Al base material extend the range for selecting suitable soldering material, soldering is made uniform between the soldering material and the tappet body and between the soldering material and the cam-slidably-contacting member, and a provide higher bonding strength than a conventional tappet is provided in which soldering is made to remain an intermediate layer which comprises only a conventional soldering material.

It is another object of the present invention to provide a method of manufacturing a tappet in which base material for a cam-slidably-contacting member made of Al which is the same as the tappet body has sufficient wear resistance.

The method of manufacturing an Al tappet in an internal combustion engine comprises the steps of holding diffusing material, which is diffusable into a tappet body which comprises base material made of Al or Al alloy body, and a cam-slidably-contacting member which comprises base material made of Al or Al alloy body between the tappet body and the cam-slidably-contacting member; and heating at least a portion which holds the diffusing material to diffuse said diffusing material into the tappet body and the cam- slidably-contacting member until a layer which comprises only the diffusion material does not substantially remain, thereby making diffusing bonding or isothermal solidification bonding.

It easily provides Al tappet in an internal combustion engine which has high bonding strength between the tappet body and the cam-slidably-contacting member.

BRIEF DESCRIPTION OF THE DRAWINGS

The features and advantages of the invention will become more apparent from the following description with respect to embodiments as shown in the accompanying drawings wherein.

DETAILED DESCRIPTION OF PREFERRED EMBODIMENTS

Figure 1:
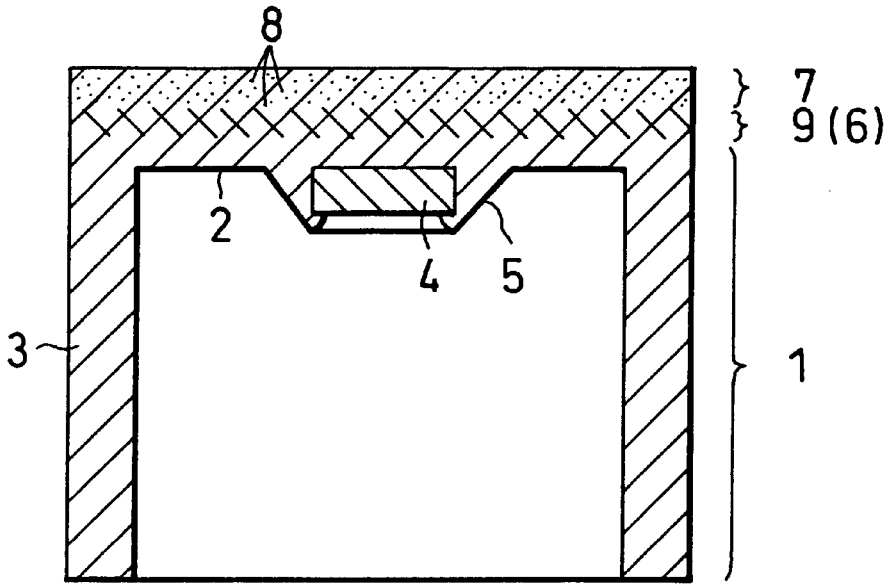
FIG. 1 is a central vertical sectional front view which shows the first embodiment of a tappet according to the present invention.
Figure 2:
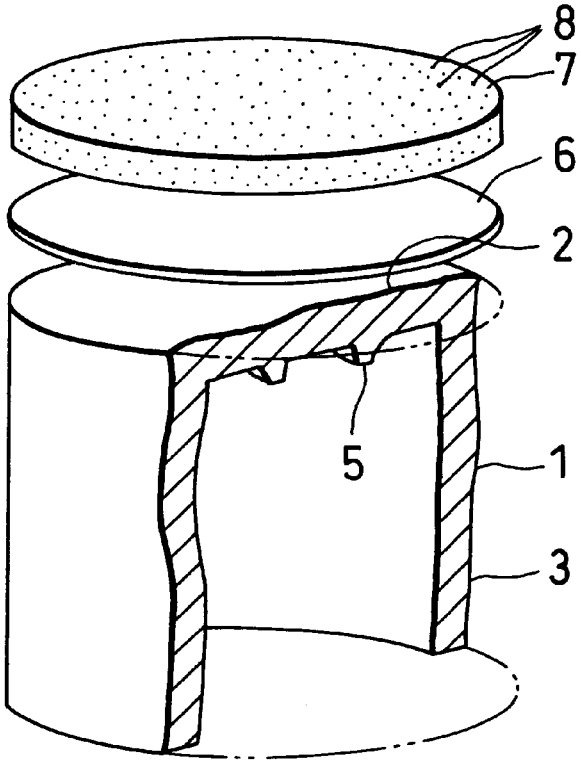
FIG. 2 is a partially sectioned exploded perspective view.

FIGS. 1 and 2 show a final product and an intermediate material before production of the first embodiment of a tappet according to the present invention. FIG. 2 illustrates how to manufacture the tappet, and FIG. 2 illustrates the structure of the tappet.

As shown in FIG. 2, a cylindrical portion 3 is provided from the outer circumference of the lower surface of a circular top wall 2 which comprises base material made of Al or Al-based light alloy. A tappet body 1 is previously formed, having an annular projection 5 in which a wear resistant inner shim 4 as shown in FIG. 1 is engaged, in the middle of the lower surface of the top wall 2.

The tappet body 1 is usually molded by die casting or machining. The upper surface of the top wall 2 may be cut or ground after die casting. Then, on the upper surface of the top wall 2 of the tappet body 1, a disc-shaped diffusing material 6 is put, and on the material 6, a disc-shaped cam-slidably-contacting member 7 which comprises base material made of Al or Al-based light alloy similar to the tappet body 1 is put. By pressing them from upper and lower positions, they are tightly combined to each other.

The diffusing material 6 may be mixture or alloy of of one or more elements of Zn, Mg, Sn, Cu, Pb, etc. which can be diffused into Al and alloy thereof by heating. The cam-slidably-contacting material 7 may be one which contains wear resistant elements 8 in the base material to achieve sufficient wear resistance even if the base material is made of Al or Al alloy.

The wear resistant elements 8 may contain particles, fibers or both made of mixture of one or more elements of SiC, silicon nitride, Zr, $Al_2O_3$, Si crystals, cobalt carbide, metal Mo, chromium carbide, CrN and intermetallic compounds.

As mentioned above, what has the diffusing material 6 between the tappet body 1 and the cam-slidably-contacting material 7 is heated in a furnace, or connecting portions are heated by heating means such as a high frequency heating device and a laser heating device, so that the diffusing material 6 is changed to a metallurgically liquid phase (solid solution) to diffuse into the base material of the tappet body 1 and the cam-slidably-contacting member 7, and to dissolve the base material in the diffusing material 6, thereby allowing an intermediate layer which comprises only the diffusing material 6 not to remain substantially. (Diffusion connection)

Isothermal solidification by diffusion reaction between the liquefied diffusing material 6 and the base material forms a uniform diffusion layer 9 in which the base material and the diffusing material 6 between the tappet body 1 and the cam-slidably-contacting member 7 are uniformly diffused to each other, as schematically shown in FIG. 1, Thereafter, it is cooled to normal temperature, and if necessary, the outer circumferential surface and other portions are machined. The inner shim 4 is engaged in the annular projection 5, which is partially plastically deformed by caulking to prevent the inner shim 4 from getting off to form a tappet as shown in FIG. 1.

It is efficient to make heat treatment for liquefying the diffusing material 6 with hardening heat treatment of the tappet body 1 and the cam-slidably-contacting member 7.

In the tappet thus finished, the base materials of the tappet body 1 and the cam-slidably-contacting member 7 are both made of Al, and between them, the diffusion layer 6 diffused into the base material to each other forms the uniform-diffusion layer 9 which is roughly equal to the base metal in strength. The tappet body 1 and the cam- slidably- contacting member 7 are strongly combined via the diffusion layer 9 to form integral material which is equal in strength.

Furthermore, the wear resistant elements 8 which are contained in the cam-slidably-contacting member 7 leads low wear and high durability even if it repeatedly contacts a cam (not shown) for operating a valve.

Figure 3:
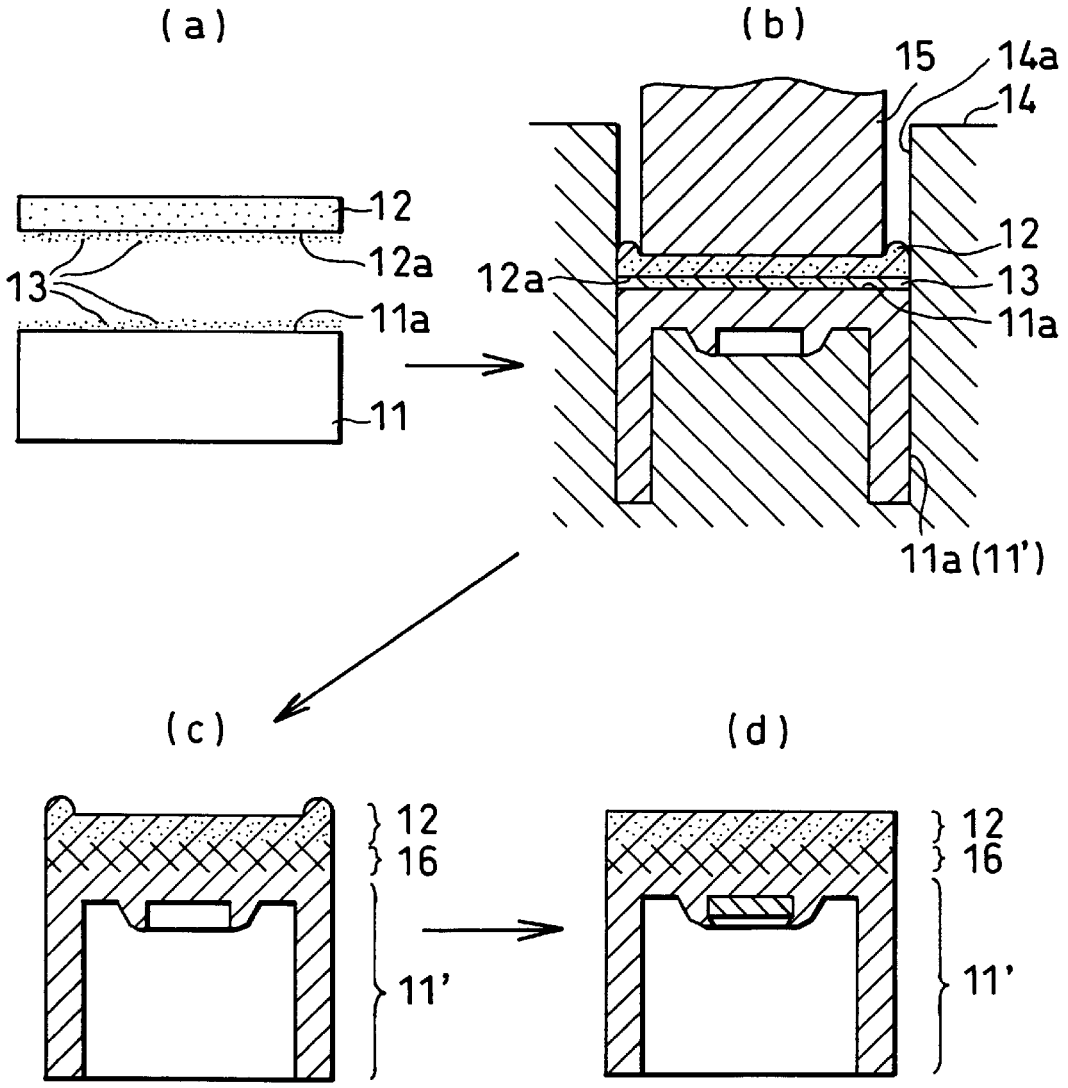
FIG. 3 is a view which illustrates the steps of the second embodiment of a method of manufacturing a tappet according to the present invention.

FIG. 3 shows the second embodiment of a method according to the present invention. On one or both of the upper surface 11*a* of a cylindrical block 11 which is made of the same material as that of the foregoing tappet 1 and the lower surface 12*a* of a disc-shaped cam-slidably-contacting member 12 which is made of the same as that of the foregoing cam-slidably-contacting member 7, powdery or granular diffusing material 12 which is the same material as that of the foregoing diffusing material 6 adheres.

As shown in FIG. 3(*b*), contacting the lower surface 12*a* with the upper surface 11*a* to which the diffusing material 13 adheres, a cope 15 which is engaged in a groove 14*a* of a drag 14 in a press is lowered and presses the cam-slidably-contacting member 12, which is pressingly contacted with the upper surface of the block 11 via the diffusing material 13, thereby deforming the cam-slidably-contacting member 12 and the block 11 plastically. The block 11 is molded to a tappet body 11' which is almost similar to the foregoing tappet body 1, and owing to flow of the block 11 and the cam- slidably- contacting member 12, fresh surfaces which are not oxidized are formed on the upper and lower surfaces.

Then, the cope 15 is elevated, and a pressed mold is taken out of the drag 14. Thereafter, similar to the first embodiment, it is heated in a furnace, and the diffusing material 13 is liquefied and diffused into the tappet body 11' and the cam-slidably-contacting member 12 to form a diffused layer 16 similar to the diffused layer 9 in FIG. 1 between the tappet body 11' and the cam-slidably-contacting member as shown in FIG. 3(*c*).

At this time, as mentioned above, the fresh surfaces formed on the upper surface 11*a* of the block 11 and the lower surface 12*a* of the cam-slidably contacting member 12 activates diffusion of the diffusing material 13.

Then, as shown in FIG. 3(*c*), required portions such as the outer circumference of a tappet before finishing and the upper surface are machined to obtain the final tappet in FIG. 3(*d*).

In the embodiment, the fresh surface is small on the lower surface 12*a* of the cam-slidably-contacting member 12, but the fresh surface on the upper surface 11*a* of the block 11 achieves sufficient advantage. One fresh surface of the opposing surfaces achieves sufficient advantage.

The foregoings merely relate to embodiments of the invention. Various changes and modifications may be made by person skilled in the art without departing from the scope of claims wherein:

What is claimed is:

1. A method of manufacturing an Al tappet in an internal combustion engine, the method comprising the steps of:

holding diffusing material, which is diffusable into a tappet body, which comprises base material made of Al or Al alloy body, and a cam-slidably-contacting member which comprises base material made of Al or Al alloy body, between the tappet body and the cam-slidably-contacting member; and heating at least a portion which holds the diffusing material to diffuse said diffusing material into the tappet body and the cam-slidably-contacting member until a layer which comprises only the diffusion material does not substantially remain, thereby making diffusing bonding or isothermal solidification bonding.

2. The method as defined in claims 1, further comprising the step of making the diffusion bonding or isothermal solidification bonding together with hardening of the tappet body.

3. The method as defined in claim 1, further comprising the step of pressing and deforming the tappet body and the cam-slidably-contacting member.

4. The method as defined in claim 1 further comprising using a cam-slidably-contacting member that contains dispersed wear resistant elements.

5. The method as defined in claim 4 further comprising using wear resistant elements, which are particles, fibers, or both particles and fibers which comprise a mixture of one or more elements of SiC, silicon nitride, Zr, $Al_2O_3$, Si crystals, cobalt carbide, metal Mo, chromium carbide, CrN and intermetallic compounds.

6. The method as defined in claim 1 further comprising using a diffusing material that comprises a mixture or alloy of one or more elements of Zn, Mg, Sn, Cu and Pb.

* * * * *